US007413023B2

(12) United States Patent
Howlett

(10) Patent No.: US 7,413,023 B2
(45) Date of Patent: Aug. 19, 2008

(54) WELLHEAD SEAL UNIT

(75) Inventor: Paul David Howlett, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 400 days.

(21) Appl. No.: 10/504,244

(22) PCT Filed: Feb. 12, 2003

(86) PCT No.: PCT/GB03/00634

§ 371 (c)(1),
(2), (4) Date: Jan. 3, 2005

(87) PCT Pub. No.: WO03/069112

PCT Pub. Date: Aug. 21, 2003

(65) Prior Publication Data

US 2005/0115715 A1 Jun. 2, 2005

(30) Foreign Application Priority Data

Feb. 13, 2002 (GB) ..... 0203386.8

(51) Int. Cl.
*E21B 33/12* (2006.01)

(52) U.S. Cl. ..... 166/387; 166/195; 166/84.4

(58) Field of Classification Search ..... 166/387, 166/386, 84.1–84.5, 195
See application file for complete search history.

(56) References Cited

U.S. PATENT DOCUMENTS

| | | | | |
|---|---|---|---|---|
| 2,120,988 A | | 6/1938 | Park | |
| 4,118,954 A | * | 10/1978 | Jenkins | 464/7 |
| 4,466,487 A | | 8/1984 | Taylor, Jr. | |
| 4,554,976 A | * | 11/1985 | Hynes et al. | 166/341 |
| 4,938,290 A | * | 7/1990 | Leggett et al. | 166/387 |
| 5,303,582 A | | 4/1994 | Miska | |
| 5,860,478 A | * | 1/1999 | Coutts et al. | 166/356 |
| RE36,244 E | * | 7/1999 | Matthews | 166/250.04 |
| 6,129,152 A | | 10/2000 | Hosie et al. | |
| 6,244,359 B1 | * | 6/2001 | Bridges et al. | 175/5 |
| 6,470,975 B1 | * | 10/2002 | Bourgoyne et al. | 175/57 |
| 6,510,895 B1 | * | 1/2003 | Koleilat et al. | 166/208 |
| 6,817,421 B2 | * | 11/2004 | Dallas | 166/379 |
| 6,988,553 B2 | * | 1/2006 | DeBerry | 166/347 |
| 2006/0102387 A1 | * | 5/2006 | Bourgoyne et al. | 175/5 |
| 2006/0180312 A1 | * | 8/2006 | Bracksieck et al. | 166/312 |

FOREIGN PATENT DOCUMENTS

| | | |
|---|---|---|
| EP | 0 301 808 | 2/1989 |
| WO | WO 99/45234 | 9/1999 |

* cited by examiner

*Primary Examiner*—Thomas A Beach
(74) *Attorney, Agent, or Firm*—C. Dean Domingue; Robert L. Waddell; Ted M. Anthony

(57) ABSTRACT

A wellhead seal unit for sealing a subsea oil and/or gas well at the wellhead. The unit comprises a sleeve, sealingly engaged to the workstring and to which, blow out preventer rams can engage. The unit allows the workstring to be rotated and reciprocated within the wellbore without releasing the seal. Methods of cleaning the sealed well and performing an inflow test are described.

11 Claims, 3 Drawing Sheets

WELLHEAD SEAL UNIT

This patent application claims an international filing date of 12 Feb. 2003 and a priority date of 13 Feb. 2002. The present invention relates to wellheads located on subsea wells and in particular, though not exclusively, to an apparatus and method of sealing a subsea well at the wellhead.

In oil and gas exploration and production, wells may be drilled on land or offshore on a seabed. Once drilled, the wells are completed prior to production via the insertion of tools or equipment into the wellbore under fixed conditions. Such conditions may include increased pressure in order to perform testing of the well. Such a test would be an inflow or negative flow test which checks the integrity of casing or liner used within the wellbore by looking for pressure leaks.

Onshore wells are completed by inserting a wellhead at ground level. The wellhead includes a lubricator through which a work string can be inserted. To prevent well fluids and particularly well pressure exiting the well past the work string a stuffing box is located at the top of the lubricator. The stuffing box includes a sealing unit which provides a seal against the work string.

In subsea wells a blow-out preventer (BOP) is typically mounted on the seabed at the entry to the well. The BOP is connected to a surface vessel or rig via a marine riser. Well fluids travel through the BOP into the marine riser to the surface. As the marine riser is typically of thin wall construction, operators must be careful to ensure that the pressure of fluids exiting the well to the marine riser are kept below a damage threshold. Unfortunately, this precludes the use of raising the pressure of the well near the surface to sufficient levels in order to undertake necessary procedures in completing the well, for instance, undertaking an inflow test.

A need has thus been recognised for a sealing mechanism provided on the seabed of a subsea well to allow for certain types of operations such as the performance of an inflow test to be performed within a subsea well.

U.S. Pat. No. 6,321,846 to Schlumberger Technology Corp discloses one such system. This Patent describes a system for use in a subsea well including a sealing element having an inner surface defining a bore in which a carrier line of a tool string may extend. A pressure-activated operator is coupled to the sealing element and is adapted to cause the sealing element to deform generally radially inwardly to allow the inner surface to apply a forced seal around the carrier line. A fluid pressure conduit extends from a sea surface pressure source to the pressure-activated operator. The sealing element is part of a pack-off device that can be used in a subsea BOP.

There are a number of disadvantages of this wellhead seal unit. The unit can only be mounted at a single precise location i.e. at the ledge against which the piston of the operator must act; a hydraulic line is required from the sea surface and it is difficult to determine if the sealing element has deformed uniformly to create a perfect seal.

It is an object of the present invention to provide a wellhead seal unit, which obviates or mitigates at least some of the disadvantages of the prior art.

It is a further object of at least one embodiment of the present invention to provide a wellhead seal unit which allows a work string to be rotated and/or reciprocated within a subsea well through the BOP.

It is a yet further of at least one embodiment of the present invention to provide a wellhead seal unit which allows an inflow test to be performed on a subsea well below the BOP.

According to a first aspect of the present invention there is provided a wellhead seal unit for use in a subsea well, the unit comprising:

a tubular body engageable in a workstring, the body having an axial through passage; and a sleeve mounted on the body through which the body can rotate and reciprocate;

wherein an inner surface of the sleeve includes one or more seals, sealingly engageable on an outer surface of the body and an outer surface of the sleeve includes a ram area against which one or more rams of a blow-out preventer are sealingly engageable.

The wellhead seal unit thus provides a seal onto a work string, which still permits the work string to be rotated and reciprocated within a wellbore. Such a sealing arrangement in a subsea well provides the opportunity to use tools which must be reciprocated or rotated in use. Additionally, the ability to reciprocate and/or rotate the work string aids in the removal of well debris by providing an agitating motion to a well fluid within the wellbore.

Preferably, the sleeve is releasably engageable to the body. More preferably, releasably engageable means are provided which may be by one or more shear pins. The shear pins may be located through the sleeve and into a portion of the body on its outer surface. Preferably also, a plug is inserted behind a head of the shear pin to ensure that once the shear pin has sheared, it is retained in both the sleeve and the body.

By use of shear pins, the seal unit is provided at a fixed location on the work string. This arrangement makes it simple to locate the seal unit in the BOP by running the string to a known depth. Additionally the ram area can be of a selected size to ensure that any error in calculating the depth still allows the rams of the BOP to engage on the ram area. Once located in the BOP rams weight can be set down on the work string to shear the pins and release the sleeve from engagement to the body.

Preferably, the tubular body comprises at least two portions. Preferably, the portions are upper and lower portions mateable via a screw thread connector. In a preferred embodiment of the present invention there are provided three portions. An upper portion or top handling sub; an extension tube; and a lower or bottom sub.

The top-handling sub may be used for slips and elevators, while the extension tube provides a fixed stroke length to the seal unit. Preferably, the extension tube has a length of at least thirty-two feet. In this way, when the tubular body is connected in the well string and the BOP has contacted the ram area by the use of the rams, the seal unit may be reciprocated into the well a distance determined from the stroke length by virtue of a base of the top handling sub meeting a top of the sleeve of the seal unit. Advantageously therefore, the sleeve is mounted on the bottom sub.

Preferably, the inner surface of the sleeve includes two recesses each arranged circumferentially on an annulus of the surface. Each recess preferably holds a seal, the seal having a surface projecting from the recess. More preferably, the recesses are located at an upper end and a lower end respectively of the sleeve. Advantageously the seals are annular o-rings as are known in the art.

According to a second aspect of the present invention there is provided a method of preparing a subsea well, for an inflow test, the method comprising the steps:

(a) providing a seal between a blow-out preventer and a work string in a subsea well bore;

(b) lining up surface pipe arrangements to take well returns through one or more choke lines in the blow-out preventer;

(c) sealing rams of the blow-out preventer around the work string at the seal;

(d) pumping fluid lighter than downhole fluid/mud through the work string to displace the downhole fluid/mud, while taking returns through the choke line;

(e) holding back pressure on the choke line to maintain a bottom hole pressure throughout the displacement; and (f) bleeding off back pressure through the choke line via a choke valve to reduce the bottom hole pressure to perform an in-flow test.

The method can be further characterised in that the work string may be rotated and/or reciprocated during the controlled displacement of the fluid/mud. Thus tools mounted on the work string may perform functions while the controlled displacement is occuring. This reduces the time taken to perform the tasks by combining tasks. Preferably, the seal is as described with respect to a wellhead seal unit as in the first aspect. By the use of such a wellhead seal unit, the method may include the additional step of setting down weight on the work string to shear the shear pins and disengage the work string from the sleeve.

According to a third aspect of the present invention, there is provided a method of cleaning a subsea well, the method comprising the steps:

(a) mounting a cleaning tool onto a work string, the work string including a wellhead seal unit;

(b) running the work string into a subsea wellbore and closing rams of a blow-out preventer around the seal unit to provide a seal to prevent passage of well fluids and pressure above the blow-out preventer;

(c) lining up surface pipe connections to take well returns through one or more choke lines;

(d) operating the cleaning tool via reciprocation and/or rotation of the tool string through the seal unit, thereby aiding removal of well debris; and (e) taking fluid returns through the choke lines to ensure fluid velocities remain high and thereby aid debris removal.

In this way, the very low annular velocities which are commonly found when cleansing subsea wells can be avoided as the return fluid is not taken up the riser mounted above the BOP, it is taken through the smaller choke lines which will ensure higher fluid velocities.

Preferably, the seal unit is as disclosed in the first aspect. Therefore, the method may include the additional step of setting down weight on the work, string to shear the shear pins and disengage the work string from the sleeve.

Embodiments of the present invention will now be described by way of example only with reference to the accompanying Figures in which.

Figure 1:
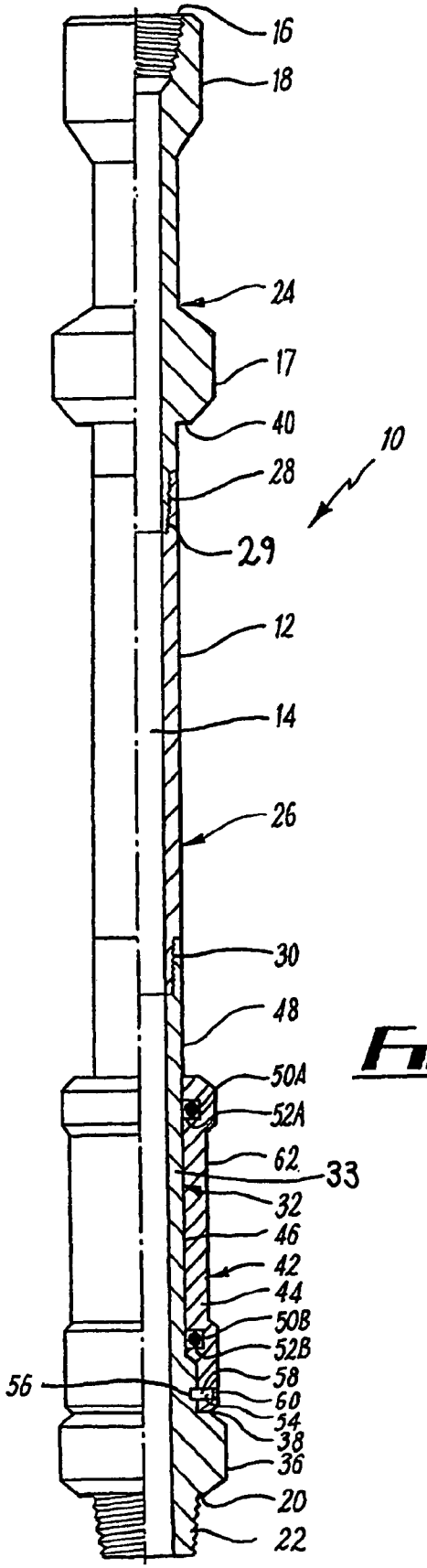
FIG. 1 is a part cross-sectional view taken through a wellhead seal unit in accordance with the present invention.

Reference is initially made to FIG. 1 of the drawings, which illustrates a wellhead seal unit, generally indicated by reference numeral 10, in accordance with the present invention. Unit 10 comprises a tubular body 12 having a cylindrical bore 14 located therethrough. At an upper end 16 of body 12 is located a box section 18. Box section 18 includes a threaded piece to connect the wellhead seal unit to a work string (not shown). At the lower end 20 of the body 12 is a threaded section 22 to connect the unit 10 into a box section of a work string positioned below the unit 10 (not shown).

Body 12 comprises three sections; an upper 24, a middle 26 and a lower 32 section. The upper section 24 is a sub designed for allowing handling of slips and elevators. The upper section 24 has a central mandrel of approximately 4 feet in length. The section 24 further includes a raised portion 17 to prevent the passage of assemblies mounted on the sub from falling. The upper section 24 is connected to the middle or extension section 26 by a threaded joint 28.

The extension section 26 is a cylindrical pipe or mandrel having a threaded portion 29 and an upper end and a similar threaded portion 30 at a lower end for connection to the upper section 24 and the lower section 32. The extension section 26 provides a length, which may be referred to as the stroke length of the unit. Typically the length will be 32 feet minimum to allow tools mounted below the seal to be reciprocated by this distance.

The lower section 32 comprises a bottom sub 33. The sub 33 is connected to the extension tube 26 at the threaded portion 30 and to the work string via the threaded pin 22. At a lower end 20 of the section 32 is a raised portion 36, which provides a shoulder 38 within the unit 10. A second shoulder 40 is also located on the body 12 of the unit 10 on the raised portion 17 of the upper section 24. Mounted around the body 12 is a sleeve 42. The sleeve is mounted between the shoulders 38, 40. Sleeve 42 comprises an annular body 44, having an inner surface 46 providing a diameter comparable to the diameter of the outer surface 48 of the body 12. In this way, the body 12 can move through the sleeve 42. The distance of travel of the body 12 relative to the sleeve 42 is governed by the length of the extension tube 26 as the sleeve 42 will be stopped at shoulders 38,40.

Sleeve 42 also includes two seals, 50A,B mounted in recesses 52A,B located on the inner surface 46 of the sleeve 42. The seals 50A,B are o-rings which sit proud of the recesses to ensure a good seal between the sleeve 42 and the body 12. The seals 50A,B prevent the passage of fluid, or debris passing between the body 12 and the sleeve 42. The seals 50A,B additionally provide a pressure seal for the well below the position of the seals.

Also located on the sleeve is an aperture 54. A matching recess 56 to aperture 54 is found on the body 12. When aperture 54 and recess 56 are aligned a shear pin 58 may be inserted through both. The shear pin 58 is held in place by virtue of a screw thread on the pin 58 and a matching thread in the recess 56 and aperture 54. A plug 60 is inserted into aperture 54 behind the shear pin 58 to prevent the pin moving out of the aperture 54. It will be appreciated that although the one shear pin is shown in FIG. 1, any number of shear pins may be used to releasably connect the sleeve 42 to the body 12.

On an outer surface 62 of the sleeve body 44 is defined the ram area. Typically this area comprises 4 feet of mandrel onto which BOP rams engage. The length can be varied to suit the BOP in use. The rams provide a seal on the outer surface 62.

In use, unit 10 is connected in a work string (not shown) via connectors 16 and 22. Unit 10 is then lowered through a riser, best seen in FIG. 2 which will be described in more detail below, until such point as the unit 10 reaches a BOP on the seabed. When located, rams on the BOP sealingly engage on the outer surface 62, or ram area, of the sleeve body 44 at the lower section 32.

Once the sleeve 42 is held in the BOP the work string is slackened off, thereby setting weight down upon the string. The weight is sufficient to shear pin 58 and allow the body 12 to run through the sleeve 42. Body 12 may also be reciprocated within the sleeve 42. This motion of reciprocation and/or rotation can be maintained without debris or fluid passing upward in the work string past the sleeve 42 by virtue of the seals 50A,B. It will be noted that the body 12 is limited in the reciprocal distance by the length of the extension section 26. Typically, the extension section will allow a stroke length of a minimum of 32 feet.

Figure 2:
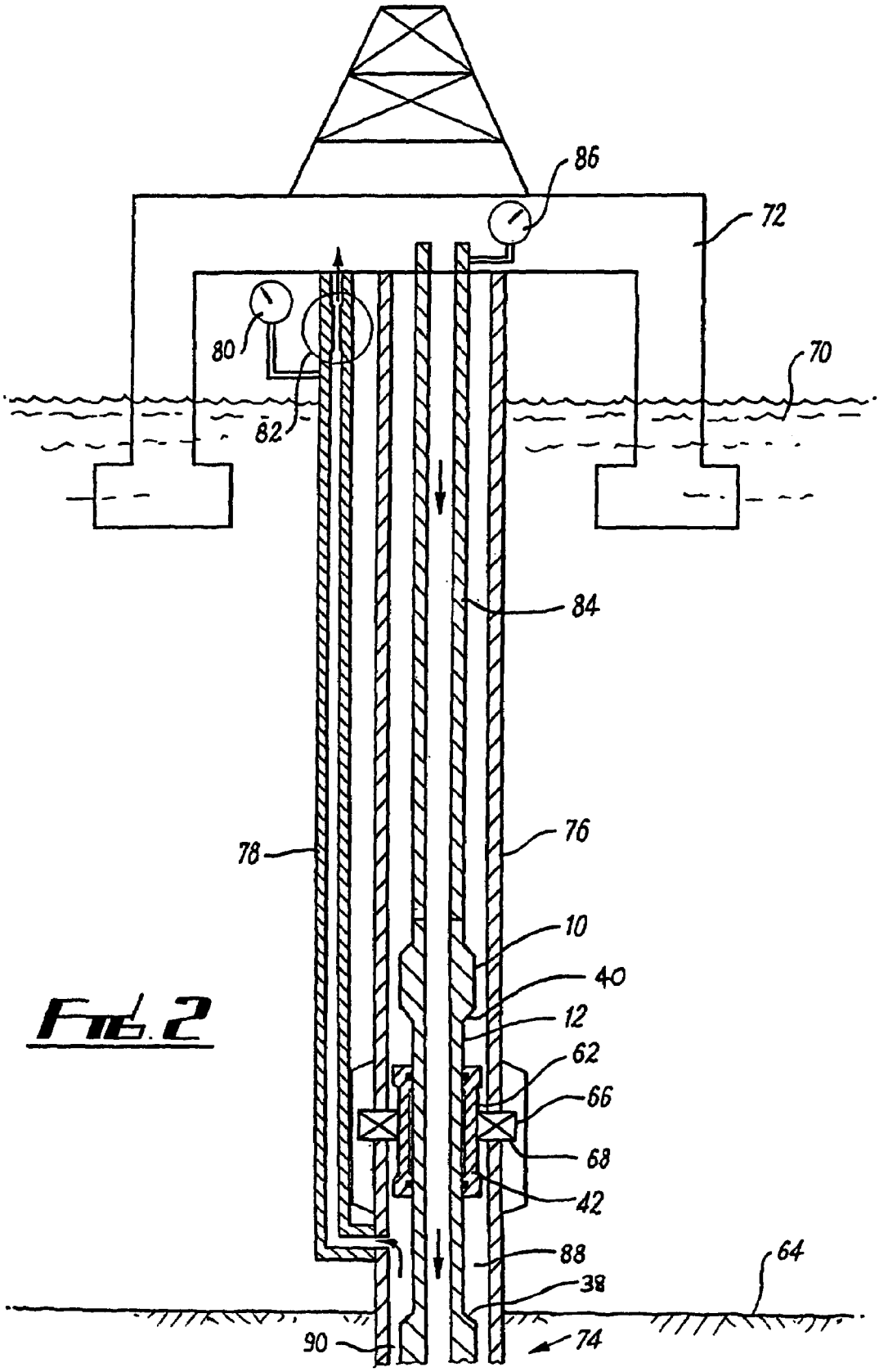
FIG. 2 is a schematic view of an arrangement for preparing a subsea well for an inflow test according to the present invention.

An application of a well seal unit of FIG. 1 is shown in FIG. 2. FIG. 2 illustrates an offshore oil and/or gas production facility accessing a well 74 from the seabed 64. Mounted relative to the seabed 64 is a BOP 66. This is not shown in full in FIG. 2, but merely representative rams 68 are illustrated.

On the surface of the sea water 70 is located a rig 72. Rig 72 is used to control, monitor and process the output of the well 74. The rig 72 is connected to the BOP 66 by virtue of a riser 76. These parts are as known in the art.

Also connected from the BOP 66 is a choke line 78 for connection of return fluids from the well 74 to the rig 72. Choke line 78 monitors pressure via a pressure gauge 80 and which is controlled via a choke valve 82. In the arrangement shown in FIG. 2 a work string 84 is lowered through a riser 76 and down into the well 74. Pressure at the rig 72 is monitored via a gauge 86.

When the unit 10 reaches the BOP 66 such that the ram area 62 is adjacent to the ram 68, the ram 68 are engaged against the outer surface 62 of the sleeve 42. Sleeve 42 is then held within the BOP 66. The work string 84 is slackened to set down weight onto the string 84 and consequently to shear the pins 58 (in FIG. 1) between the sleeve 42 and the body 12 of the unit 10. The work string 84 may then be raised, lowered and/or rotated through a distance equal to the distance between the shoulders 38, 40 of the unit 10. This distance is the stroke length of the unit 10. This movement is conducted without the downhole fluid 88, escaping up the marine riser 76 through the BOP 66. Well fluid may only return through the choke line 78.

In order to conduct an inflow test within the well 74, a lighter fluid compared with the downhole fluid or mud located in the well 74 is pumped down the string 84. The lighter fluid displaces the downhole fluid or mud and eventually fills the string and the annulus 90 with the return fluid taken through the choke line 78. Choke valve 82 is used to ensure that the bottom hole pressure provided by monitoring pressure gauges 80 and 86 is equal to the pressure at the rig 72. This equality and pressure is maintained through the controlled displacement of the fluid. An inflow test may be performed by slowly bleeding off pressure through the choke valve 82 to reduce the bottom hole pressure accordingly. Advantageously the work string 84 can be moved during the fluid displacement.

Figure 3:
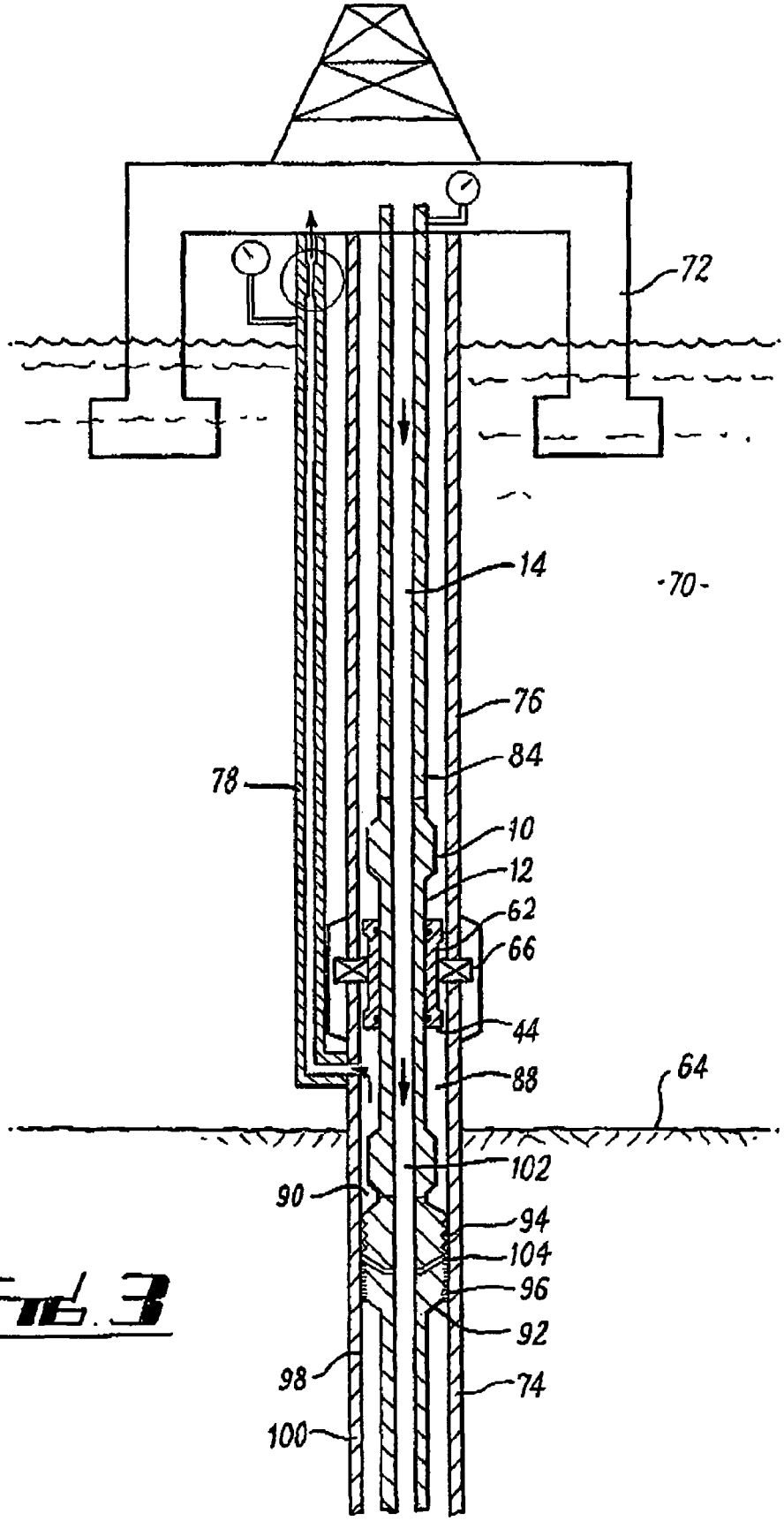
FIG. 3 is a schematic view of a cleaning operation conducted in a subsea well in accordance with the present invention.

Reference is now made to FIG. 3 of the drawings, which illustrates a further application of the well seal unit 10. Parts in FIG. 3 identical to those in FIG. 2 have been given the same reference numeral and operate in an identical manner. The work string 84 in this embodiment includes a cleaning tool 92 positioned below the unit 10. As described previously, work string 84 is run into the well 74 to a depth such that the ram area 62 of the sleeve 44 can engage rams 68 of the BOP 66. Once the sleeve 44 is disengaged from the body 12 of the unit 10 the cleaning tool 92 can be operated within the well 74. This is achieved through reciprocation and/or rotation of the work string 84 which allows scrapers 94 and brushes 96 mounted on the tool 92 to clean the inside walls 98 of the casing 100 within the well 74.

A principal advantage of the present invention is that it provides a sealing unit for use in a subsea well to allow rotation and reciprocation of a well string within the subsea well while preventing loss of pressure and or fluids.

A further advantage of the present invention is that it provides a method of performing an inflow test on a subsea well through the use of a sealing unit positioned in the blow-out preventor. The method movement of the work string while a controlled displacement of fluid is made.

A further advantage of the present invention is that it provides a sealing unit which can be mounted upon a work string for selective use and connection to a subsea well.

As the sleeve of the unit has a diameter no greater than that found on subs mounted on the work string, the unit can remain on a work string and the string operated normally until such time as a seal is required.

It will be appreciated by those skilled in the art that various modifications may be made to the invention herein described without departing from the scope thereof. For example, it will be appreciated that a number of tools may be run on the work string in connection with the wellhead seal unit, although only a cleaning tool has been described. Similarly though the description relates to a work string it will be understood that this may include a drill string or drill pipe.

The invention claimed is:

1. A wellhead seal unit for use in a subsea well, the unit comprising:

a tubular body engageable in a work string, the body having an axial through passage; and a sleeve mounted on the body through which the body can rotate and reciprocate axially relative to the sleeve;

an inner surface of the sleeve including one or more seals, sealingly engageable on an outer surface of the body;

an outer surface of the sleeve including a ram area against which one or more rams of a blow-out preventer are sealingly engageable; and wherein the sleeve includes releasably engageable means to releasably engage the sleeve to the body to restrict rotation and axial reciprocation of the body relative to the sleeve, the releasably engageable means being releasable when the unit is located in the blow-out preventer rams and the rams sealingly engaged to the sleeve outer surface, to thereby permit rotation and axial reciprocation of the body relative to the sleeve.

2. A wellhead seal unit as claimed in claim 1 wherein the tubular body comprises a plurality of portions.

3. A wellhead seal unit as claimed in claim 2 wherein the portions are mateable by a screw thread connector.

4. A wellhead seal unit as claimed in claim 2 wherein there are three portions, a top handling sub, an extension tube and a bottom sub.

5. A wellhead seal unit as claimed in claim 4 wherein the extension tube has a length equal to a stroke length of the seal unit.

6. A wellhead unit as claimed in claim 4 wherein the sleeve is mounted on the bottom sub.

7. A wellhead seal unit as claimed in claim 1 wherein the inner surface of the sleeve includes one or more recesses each arranged circumferentially on an annulus of the surface.

8. A wellhead seal unit as claimed in claim 7 wherein each recess holds one of the seals, the seal having a surface projecting from the recess.

9. A wellhead seal unit as claimed in claim 7 wherein the recesses are located at an upper end and a lower end respectively of the sleeve.

10. A wellhead seal unit as claimed in claim 1, wherein the releasably engageable means is one or more shear pins, located through the sleeve and into the body.

11. A wellhead seal unit as claimed in claim 10 wherein a plug is inserted behind a head of the/each shear pin to ensure that once the/each shear pin has sheared, it is retained in both the sleeve and the body.

* * * * *